US008209078B2

(12) United States Patent
Okada

(10) Patent No.: US 8,209,078 B2
(45) Date of Patent: Jun. 26, 2012

(54) ELECTRONIC CONTROL UNIT AND VEHICLE CONTROL SYSTEM

(75) Inventor: Kazunori Okada, Chiryu (JP)

(73) Assignee: Denso Corporation, Kariya (JP)

( * ) Notice: Subject to any disclaimer, the term of this patent is extended or adjusted under 35 U.S.C. 154(b) by 269 days.

(21) Appl. No.: 12/782,817

(22) Filed: May 19, 2010

(65) Prior Publication Data

US 2010/0299023 A1 Nov. 25, 2010

(30) Foreign Application Priority Data

May 20, 2009 (JP) ..... 2009-121977

(51) Int. Cl.
*G01M 17/00* (2006.01)

(52) U.S. Cl. ..... 701/29.6; 701/1; 701/101; 701/113; 701/114; 340/438; 340/933; 340/440; 340/681; 340/459

(58) Field of Classification Search ..... 701/29.6, 701/1, 101, 113–114; 340/438, 933, 440, 340/681, 459, 5.64, 5.72, 671, 439
See application file for complete search history.

(56) References Cited

U.S. PATENT DOCUMENTS

| | | | | |
|---|---|---|---|---|
| 5,479,347 | A | 12/1995 | Oguro et al. | |
| 6,243,627 | B1 | 6/2001 | Ozeki | |
| 8,095,263 | B2 * | 1/2012 | Yasue et al. | 340/3.42 |
| 2008/0201035 | A1 | 8/2008 | Kondoh et al. | |
| 2009/0271063 | A1 | 10/2009 | Yasue et al. | |

FOREIGN PATENT DOCUMENTS

| | | |
|---|---|---|
| JP | 7-002032 | 1/1995 |
| JP | 10-63542 | 3/1998 |
| JP | 11-238005 | 8/1999 |
| JP | 2000-185606 | 7/2000 |
| JP | 2001-301572 | 10/2001 |
| JP | 2004-136701 | 5/2004 |
| JP | 2005-297652 | 10/2005 |
| JP | 4281392 | 3/2009 |
| JP | 2009-262679 | 11/2009 |

* cited by examiner

*Primary Examiner* — Thomas G. Black
*Assistant Examiner* — Luke Huynh
(74) *Attorney, Agent, or Firm* — Nixon & Vanderhye PC

(57) ABSTRACT

An electronic control unit (ECU) and a vehicle control system are disclosed. When a vehicle ID rewrite instruction and a malfunction information erasure instruction are inputted to the system from an external scantool, one ECU in the system erases the malfunction information stored therein and determines whether the malfunction information stored in another ECU has been erased. When it is determined that the malfunction information stored in every ECU has been erased, the vehicle ID is rewritten. According to the above system, it is possible to prevent violation of a requirement, the requirement being such that when a vehicle ID is rewritten, malfunction information should be erased at the same time.

10 Claims, 8 Drawing Sheets

ELECTRONIC CONTROL UNIT AND VEHICLE CONTROL SYSTEM

CROSS REFERENCE TO RELATED APPLICATION

The present application is based on Japanese Patent Application No. 2009-121977 filed on May 20, 2009, disclosure of which is incorporated herein by reference.

BACKGROUND OF THE INVENTION

1. Field of the Invention

The present invention relates to an electronic control unit storing therein vehicle identification information, which is unique on a vehicle-by-vehicle basis. The present invention also relates to a vehicle control system.

2. Description of Related Art

A modern vehicle is equipped with a vehicle control system, which includes multiple electronic control units (also called ECUs) for controlling parts of the vehicle. As is described in JP-2001-301572A for example, a specific one of the ECUs rewritably stores a vehicle identification number (also called a VIN code), which is unique on a vehicle-by-vehicle basis, in a non-volatile memory thereof such as an EEPROM (electrically erasable and programmable read only memory) and the like.

When the ECU storing the VIN code is detached from one vehicle and is re-mounted in a different vehicle, the VIN code in the ECU is rewritten. The VIN code is used for identification of a vehicle when, for example, a dealer repairs a vehicle. Through the identification of a vehicle, the dealer can provide a more suitable treatment that matches a type of the vehicle.

In connection with a vehicle control system, OBD-II (On-Board Diagnostics II) issued by CARB (California Air Resources Board) requires that malfunction information indicative of vehicle malfunction be stored in a non-volatile memory, which is for example an EEPROM or a continuously-powered memory such as standby RAM (random access memory), SRAM (static random access memory) and the like. Because of this requirement, malfunction information is stored in a non-volatile memory of each ECU in a vehicle control system.

OBD-II also requires that when the VIN code is rewritten, all of malfunction information associated with an emission system be erased at the same time. Because of this requirement, it is necessary to reliably erase the emission-related malfunction information when rewriting the VIN code stored in a specific ECU.

The inventor of the present application has found that a conventional way of erasing malfunction information in ECUs involves the following difficulty. In the conventional way, after the VIN code is rewritten, an instruction for erasing the malfunction information is inputted to each ECU from an external tool. However, if an ECU is powered-off or reset during erasure of the malfunction information, the malfunction information in the ECU remains unerased although the rewrite of VIN code has been completed. This may lead to violation of the requirement of OBD-II.

SUMMARY OF THE INVENTION

In view of the above and other difficulties, it is an objective of the present invention to provide an electronic control unit and a vehicle control system that can rewrite vehicle identification information while preventing violation of a requirement, where the requirement is such that when a VIN code is rewritten, malfunction information be erased at the same time.

According to a first aspect of the present invention, an electronic control unit for a vehicle is provided. The electronic control unit includes: a vehicle identification information storage section storing therein vehicle identification information, which is unique on a vehicle-by-vehicle basis; and a rewrite section configured to rewrite the vehicle identification information stored in the vehicle identification information storage section in response to an input of a vehicle identification information rewrite instruction thereto. The electronic control unit is connected with an electronic apparatus via an in-vehicle network of the vehicle. The electronic apparatus includes: a malfunction information storage section storing therein malfunction information of the vehicle; and an erasure section configured to erase the malfunction information stored in the malfunction information storage section in response to an input of a malfunction information erasure instruction thereto. The electronic control unit further includes: an instruction detection section configured to detect an input of instruction information, the input of the instruction information including the input of the vehicle identification information rewrite instruction and the input of the malfunction information erasure instruction; and an erasure determination section configured to determine, in response to detection of the input of the instruction information by the instruction detection section, whether the malfunction information in the electronic apparatus has been erased by the erasure section. The rewrite section rewrites the vehicle identification information when the erasure determination section determines that malfunction information in the electronic apparatus has been erased.

According to a second aspect of the present invention, a vehicle control system mounted to a vehicle is provided. The vehicle control system includes: a vehicle identification information storage section storing therein vehicle identification information, which is unique on a vehicle-by-vehicle basis; a malfunction information storage section storing therein malfunction information, which is information on malfunction of the vehicle; a rewrite section configured to rewrite the vehicle identification information stored in the vehicle identification information storage section in response to an input of a vehicle identification information rewrite instruction thereto; an erasure section configured to erase the malfunction information stored in the malfunction information storage section in response to an input of a malfunction information erasure instruction thereto; an instruction detection section configured to detect an input of instruction information, the input of the instruction information including the input of the vehicle identification information rewrite instruction and the input of the malfunction information erasure instruction; and an erasure determination section configured to determine, when the instruction detection section detects the input of the instruction information, whether the malfunction information has been erased by the erasure section. The erasure section erases the malfunction information stored in the malfunction information storage section when the instruction detection section detects the input of the instruction information. The rewrite rewrites the vehicle identification information when the erasure determination section determines that malfunction information has been erased by the erasure section.

According to the above electronic control unit and the vehicle control system, it is possible to reliably rewrite vehicle identification information while preventing violation of a requirement, the requirement being such that when a VIN code is rewritten, malfunction information be erased at the same time.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE EXEMPLARY EMBODIMENTS

The exemplary embodiments are illustrated below with reference to the accompanying drawings.

First Embodiment

A first embodiment will be described below.

Figure 1:
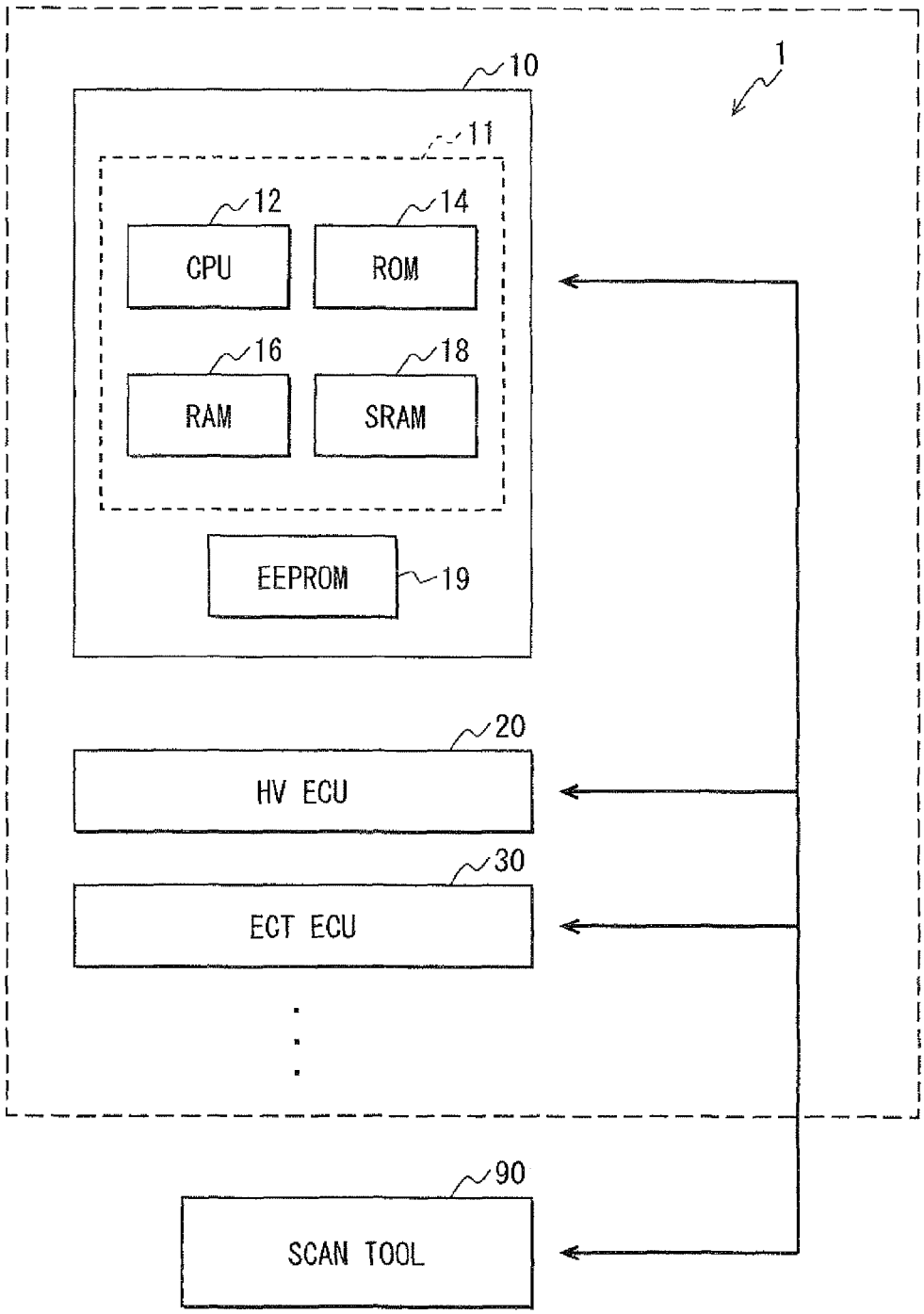
FIG. 1 is a diagram illustrating a vehicle control system according to embodiments.

FIG. 1 schematically illustrates a vehicle control system 1 for a vehicle according to the first embodiment. In the present disclosure, an ECU stands for an electronic control unit. As shown in FIG. 1, the vehicle control system 1 includes various ECUs such as an engine ECU 10 for controlling drive of an engine (not shown) of the vehicle, a HVECU 20 for calculating a command value associated with, for example, an output of the engine, an ECTECU 30 for controlling a gear ratio of an automatic transmission of the vehicle, and the like. The engine ECU 10, the HVECU 20 and the ECTECU are connected and communicatable with each other via, for example, an in-vehicle network.

The engine ECU 10 includes a microcomputer 11 and an EEPROM 19 acting as a non-volatile memory. The EEPROM 19 stores therein a vehicle identification number (also called a VIN code), which is unique on a vehicle-by-vehicle basis. The VIN code is typically determined in a process of assembling a vehicle. In the assembling process, a tool for rewriting a VIN code is connected to the engine ECU 10 and the VIN code is rewritten to the EEPROM 19 via the tool.

The microcomputer 11 includes a CPU 12 (central processing unit), a ROM 14 (read-only-memory), a RAM 16 (random access memory) and a SRAM 18 (static random access memory). The CPU 12 is operable according to a program. The ROM 14 stores the program to be executed by the CPU 12 and data to be referenced in the execution of the program. The RAM 16 stores a result of computation made by the CPU 12, and the like. Power is continuously supplied to the SRAM 18, and data in the SRAM 18 is maintainable even if an ignition switch of the vehicle is turned off. Malfunction information used in diagnosis of vehicle malfunction is stored in, for example, the SRAM 18.

Although not shown in the drawings, each of the HVECU 20 and the ECTECU 30 also has a microcomputer like the microcomputer 11 has. In each of the HVECU 20 and the ECTECU 30 also, the malfunction information used in malfunction diagnosis is stored in, for example, the SRAM of the microcomputer.

A scantool 90 is connectable to the vehicle control system 1. The scantool 90 is used to rewrite the VIN code or make the malfunction diagnosis through reading the malfunction information.

Figure 2:
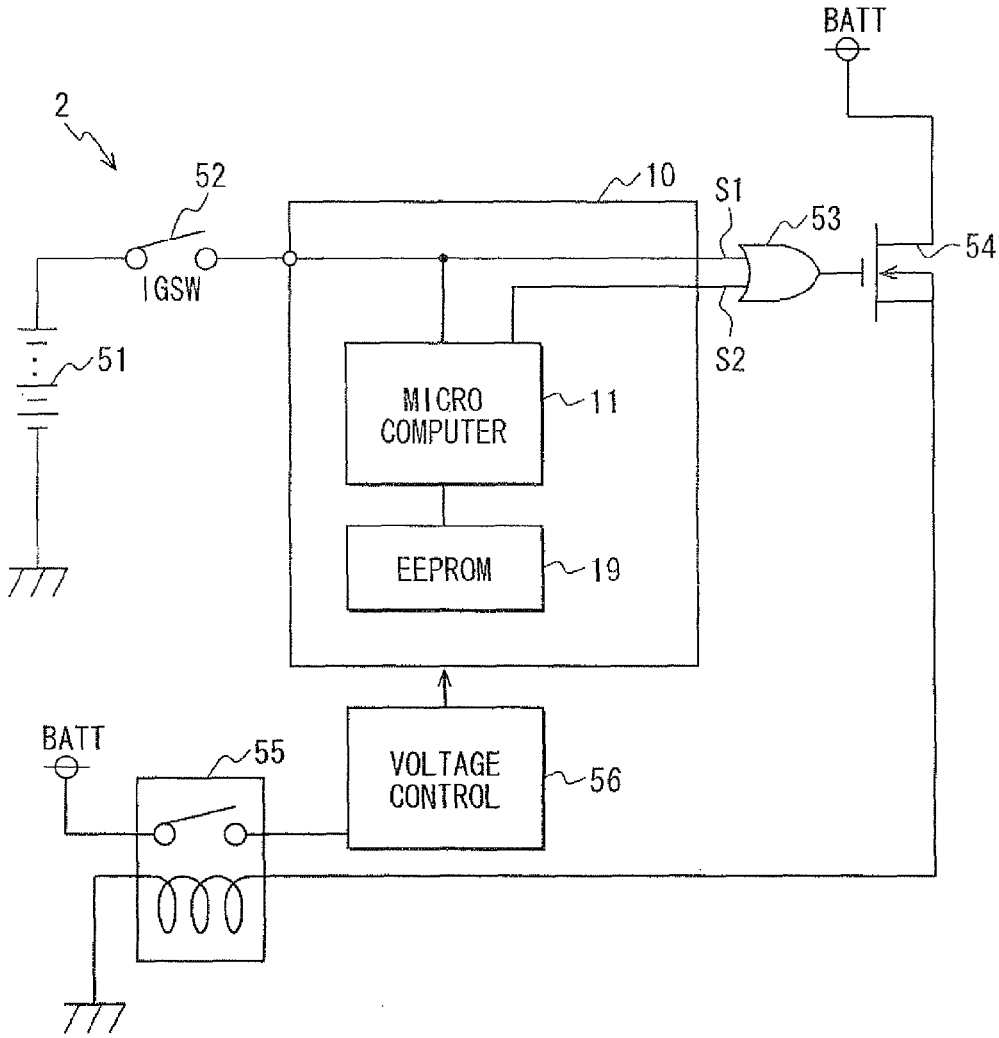
FIG. 2 is a diagram illustrating a voltage supply system according to embodiments.

FIG. 2 is a block diagram illustrating a peripherical configuration of the engine ECU 10. More specifically, FIG. 2 illustrates a voltage supply system 2 for supplying a voltage to the engine ECU 10. The voltage supply system 2 supplies the voltage from a battery 51 to the engine ECU 10.

When the ignition switch (IGSW) 52 of the vehicle is turned on, an ON signal is inputted to an OR circuit 53 via a signal line S1. In some cases, the microcomputer 11 inputs a predetermined hold signal to the OR circuit 53 via a signal line S2. When receiving the ON signal from the IGSW 52 or the hold signal from the microcomputer 11, the OR circuit 53 outputs a signal, which is inputted to a base terminal of a transistor 54. A collector terminal of the transistor 54 is connected with a battery electric potential, and an emitter terminal of the transistor 54 is connected with a relay 55. In response to the input of the signal from the OR circuit 53 to the base terminal, the transistor 54 is switched on, and an electric current flows from the battery to the relay 55 via the transistor 54, thereby switching on the relay 55. In this case, one end of a switch of the relay 55 is connected with the battery electric potential, and another end of the switch of the relay 55 is connected with a voltage control circuit 56. Thus, when the relay 55 is switched on, a battery voltage is supplied to the voltage control circuit 56 via the relay 55. The voltage control circuit 56 steps down the battery voltage to a predetermined voltage level for operation of the microcomputer 11 of the engine ECU 10 and supplies the step-downed voltage to the microcomputer 11.

Figure 3:
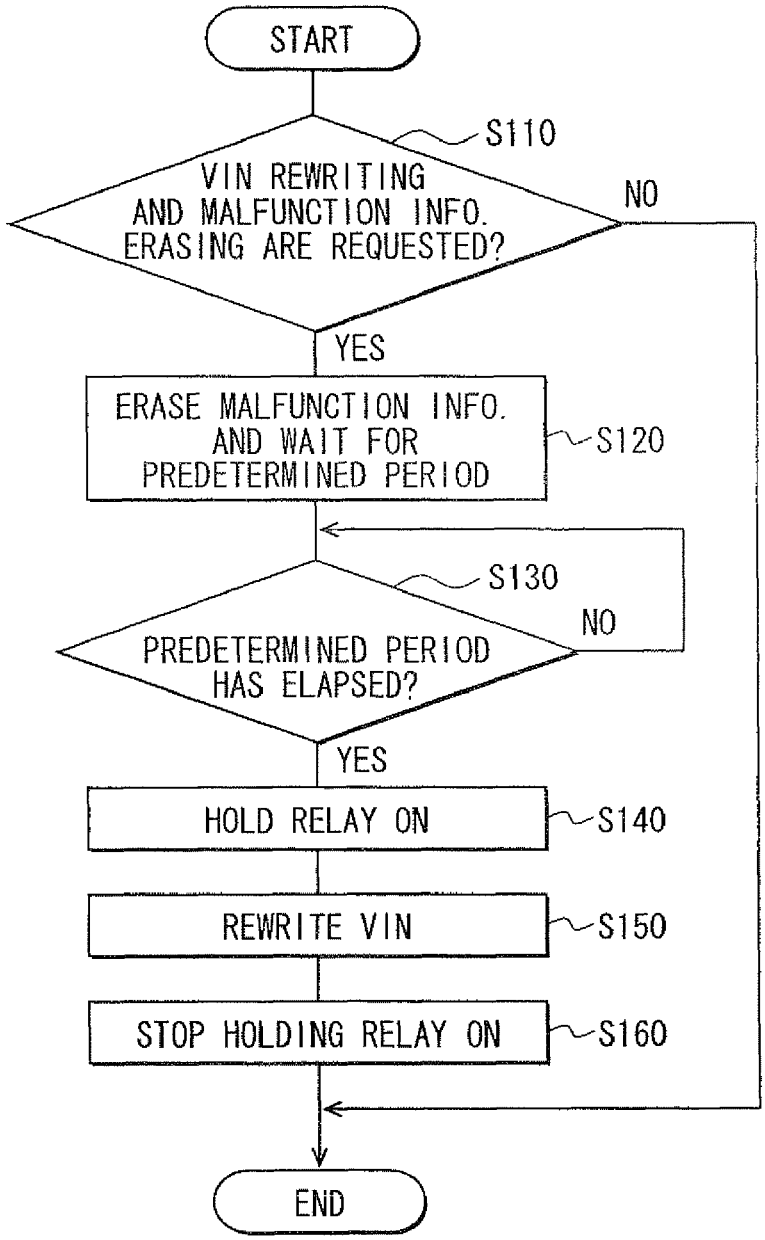
FIG. 3 is a flowchart illustrating a rewriting procedure to be performed by an engine ECU according to a first embodiment.

In the followings, explanation is given on processes to be performed by the microcomputer 11 of the engine ECU 10. FIG. 3 is a flowchart illustrating a rewriting procedure to be performed by the CPU 12 of the microcomputer 11. The rewriting procedure is performed to rewrite the VIN code. When the microcomputer 11 is in operation, the rewriting procedure is cyclically performed in predetermined timing.

As shown in FIG. 3, at S110, the CPU 12 determines whether an instruction for rewriting a VIN code and an instruction for erasing malfunction information are inputted to the vehicle control system 1. The above instructions are also referred to as instruction information. The instruction information is inputted from the scantool 90 (see FIG. 1), which is external with respect to the vehicle control system 1. The instruction information inputted from the scantool 90 is also detected by the HVECU 20 and the ECTECU 30 in addition to the engine ECU 10.

When the CPU 12 determines that the instruction information is not inputted, corresponding to "NO" at S110, the rewriting procedure is ended. When the CPU 12 determines that the instruction information is inputted, corresponding to "YES" at S110, the process proceeds to S120.

At S120, the CPU 12 erases the malfunction information stored in the ECU (engine ECU 10) having the CPU 12. More specifically, the CPU 12 erases the malfunction information stored in the SRAM 18 of the microcomputer 11. In addition, at S120, the CPU 12 waits for a predetermined period (e.g., 500 msec). The predetermined period is determined, for example, in design of the vehicle control system 1 and is set sufficiently longer than a period taken to erase malfunction information. In the above, this period taken to erase the malfunction information involves all of ECUs having malfunction function to be erased. For example, when not only the engine ECU 10 but also the HVECU 20 and the ECTECU 30 store the malfunction information to be erased, a period taken to erase the malfunction information in all of the engine ECU 10, the HVECU 20 and the ECTECU 30 after start of malfunction information erasure is referred to herein as "the period taken to erase the malfunction information".

At S130, the CPU 12 determines whether the predetermined period has elapsed after the input of the instruction information. When the CPU 12 determines that the predetermined period has not elapsed, corresponding to "NO" at S130, the CPU performs S130 again. When the CPU 12 determines that the predetermined period has elapsed, corresponding to "YES" at S130, the process proceeds to S140.

S140, the CPU 12 outputs a command to hold the relay 55 on. More specifically, the CPU 12 output the hold signal for maintaining the relay 55 at an ON state. As is described above with reference to FIG. 2, the hold signal is inputted to the OR circuit 53 via the signal line S2. While the hold signal is outputted from the microcomputer 11, the relay 55 is maintained at the ON state and the voltage supply to the microcomputer 11 is maintained even if the ignition switch 52 of the vehicle is turned off.

After S140, the process proceeds to S150 to perform a VIN code rewriting operation. A new VIN code with which the present VIN code is to be replaced is inputted together with the VIN code rewriting request from the external scantool 90. At S150, the CPU 12 rewrites the VIN code stored in the EEPROM 19 by replacing the present VIN code with the new VIN code inputted from the external scantool 90.

At S160, the relay 55 stops outputting the command to hold the relay 55 on. More specifically, the output of the hold signal is stopped. After S160, the rewriting procedure is ended.

According to the above rewriting procedure of the first embodiment, when the instruction information such as the instruction for rewriting a VIN code and the instruction for erasing malfunction information is inputted from the external scantool 90 (corresponding to "YES" at S110), the VIN code rewriting operation is performed at S150 after a period longer than that taken to erase the malfunction has elapsed from a start time of the erasure of the malfunction information (corresponding to S120 and "YES" at S130).

Since the VIN code rewriting operation is performed at a stage where a period sufficiently longer than that taken to erase the malfunction information has elapsed, it is possible to rewrite the VIN code at a stage where the malfunction information has been erased. In other words, the VIN code rewriting operation is prohibited from being performed at a stage where the malfunction information has not been erased.

According to the vehicle control system 1 of the present embodiment, it is possible to prevent violation of a requirement of OBD-II (On-Board Diagnostics II) issued by CARB (California Air Resources Board), where the requirement is such that malfunction information be erased when a VIN code is rewritten.

Moreover, according to the present embodiment, the microcomputer 11 outputs the hold signal during the rewriting of the VIN code (corresponding to S140). Thus, even if the ignition switch 52 of the vehicle is turned off during the rewriting of the VIN code, the voltage supply to the microcomputer 11 is prevented from being cut off because the relay 55 is maintained at the ON state due to the hold signal. The stop of the VIN code rewriting operation due to the turning off of the ignition switch 52 is prevented. It is therefore possible to rewrite the VIN code in a reliable manner.

Moreover, since the VIN code rewriting operation is performed at a stage after the elapse of the predetermined period, it is unnecessary to change a hardware or software configuration of another ECU, which is other than the engine ECU 10 and has malfunction information to be erased. Thus, the present embodiment has an advantage in cost and man-hour.

In the present embodiment, the EEPROM 19 can correspond to vehicle identification information storing section or means. The process S150, conducted by the use of the CPU, can correspond to rewrite section or means. The SRAM 18 can correspond to malfunction information storing section or means. The process S120 can correspond to erasure section or means. The process S110 can correspond to instruction detection section or means. The process S130 can correspond to erasure determination section or means. The relay 55 can correspond to operating voltage supply switch or switching means. A state where the switch of the relay 55 is closed can correspond to supply state. A state where the switch of the relay 55 is open can correspond to cut-off state. Each of the above-mentioned section or means is merely an illustrated example and not limited to the above-described corresponding item.

Second Embodiment

A vehicle control system 1 according to a second embodiment will be described below.

Figure 4:
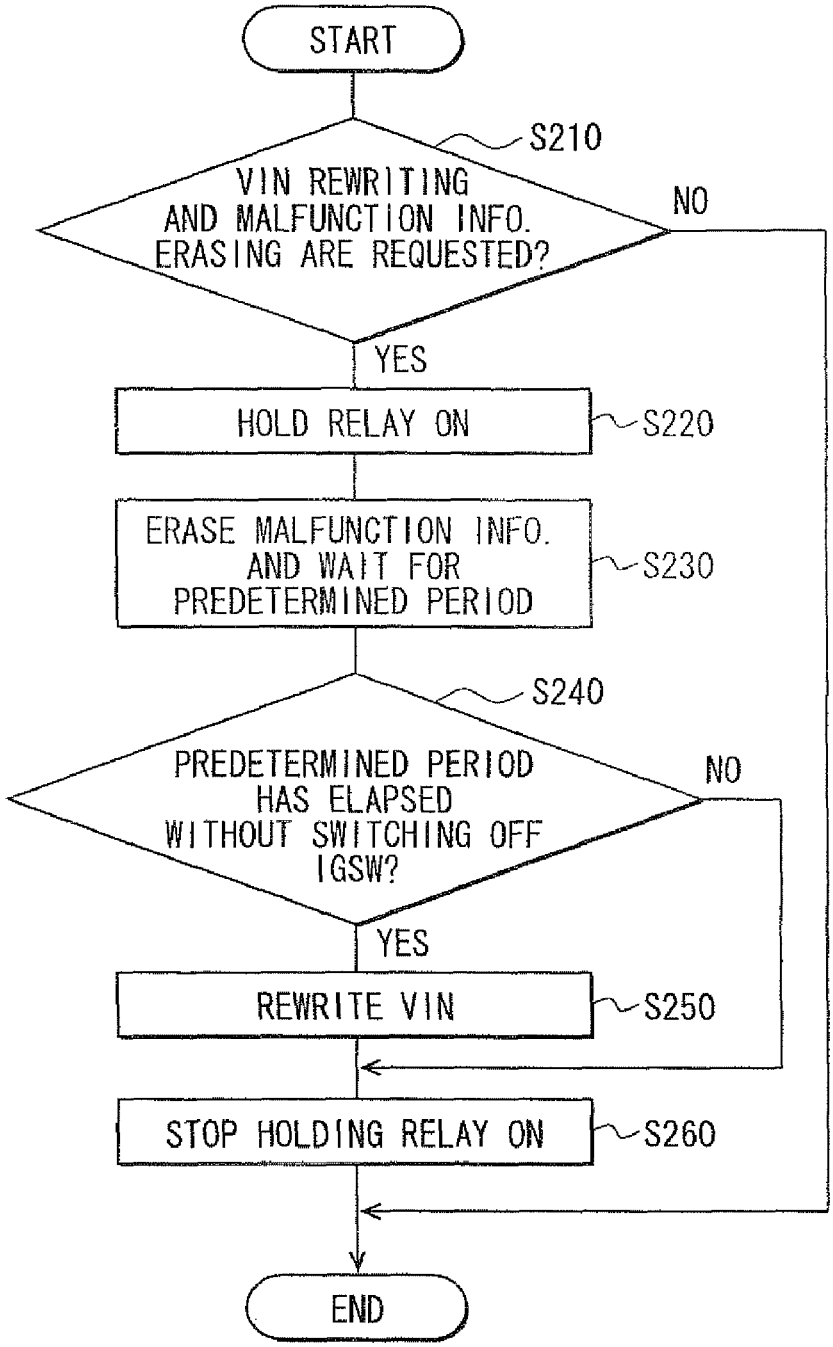
FIG. 4 is a flowchart illustrating a rewriting procedure to be performed by an engine ECU according to a second embodiment.

The vehicle control system 1 of the second embodiment is different from that of the first embodiment in that the vehicle control system 1 of the second embodiment performs a rewriting procedure illustrated in FIG. 4 in place of that illustrated in FIG. 3. In the followings, explanation is given on the rewriting procedure illustrated in FIG. 4.

As shown in FIG. 4, at S210, the CPU 12 determines whether the instruction information is inputted. Since the process S210 is the same as the process S110 in FIG. 3, the detailed explanation on S210 is omitted.

When the CPU 12 determines that the instruction information is not inputted, corresponding to "NO" at S210, the rewriting procedure is ended. When the CPU 12 determines that the instruction information is inputted, corresponding to "YES" at S210, the process proceeds to S220.

At S220, the CPU 12 outputs the command to hold the relay 55 on. More specifically, the hold signal is outputted to the OR circuit 53 via the signal line S2 (see FIG. 2). At S230, the CPU 12 erases the malfunction information stored in the ECU having the CPU 12 (i.e., in the engine ECU 10). Further, at S230, the CPU 12 waits for a predetermined period. The predetermined period is set sufficiently longer than a period taken to erase the malfunction information, as described in the first embodiment.

After S230, the process proceeds to S240. At S240, the CPU 12 determines whether the predetermined period has elapsed, and determines whether there is a history of switching off the ignition switch 52 of the vehicle during the elapse of the predetermined period.

When the CPU 12 determines that the predetermined period has elapsed, and that there is no history of switching off the ignition switch 52 of the vehicle during the elapse of the predetermined period, the determination "YES" is made at S240, and the process proceeds to S250.

When the CPU 12 determines that there is a history of switching off the ignition switch 52, the determination "NO" is made at S240, the process proceeds to S260. At S250, the VIN code rewriting operation is performed. A new VIN code with which the present VIN code is replaced is inputted together with the instruction for rewriting the VIN code from the external scantool 90. After S250, the process proceeds to S260.

At S260, the CPU 12 stops outputting the command to hold the relay 55 on. More specifically, the CPU 12 stops outputting the hold signal. After S260, the rewriting procedure is ended.

According to the above rewriting procedure of the second embodiment, when the instruction information such as the VIN code rewrite instruction and the malfunction information erasure instruction is inputted to the vehicle control system 1 from the external scantool 90 (corresponding to "YES" at S210), the VIN code is rewritten at S250 if a period sufficient to erase the malfunction information has elapsed after a start time of erasing the malfunction information and if the ignition switch 52 of the vehicle has not been turned off during the elapse of the predetermined period (i.e., during the erasure of the malfunction information) (corresponding to "YES" at S240).

In some cases, an ECU may be configured such that the turning off of the ignition switch 52 during the erasure of the malfunction information leads to the cut of voltage supply. In this case, there is a possibility that the erasure of the malfunction information may be stopped and the malfunction information may not be erased but remain unerased.

However, when a period sufficiently longer than that taken to erase the malfunction information has elapsed after a start time of erasing the malfunction information and when the ignition switch was not turned off during the elapse of the period (i.e., during the erasure of the malfunction information), the malfunction information should be successfully erased unless special abnormalities does not take place.

In view of the above, the vehicle control system 1 of the second embodiment performs the VIN code rewriting operation at a stage where the malfunction information has been erased. In other words, the VIN code rewriting operation is prohibited from being performed at a stage where there is a possibility that the malfunction information has not been erased.

Therefore, according to the vehicle control system 1 of the second embodiment, it is possible to prevent the above-described requirement of OBD-II from being violated. Moreover, according to the second embodiment, the vehicle control system 1 outputs the hold signal to hold the relay 55 on (corresponding to S220) during the erasure of the malfunction information and the rewriting of the VIN code. Thus, even if the ignition switch 52 is turned off during the output of the hold signal, it is possible to maintain the voltage supply to the engine ECU 10 and it is possible to erase the malfunction information and rewrite the VIN code in at least the engine ECU 10.

In the present embodiment, the process S220 and S260 after "NO" at S240, conducted by the use of the CPU, can correspond to operating voltage supply control section or means. The process S240 can correspond to erasure determination section or means. The process S240 can correspond to off-determination portion, section or means. Each of the above-mentioned section or means is merely an illustrated example and not limited to the above-described corresponding item.

Third Embodiment

A vehicle control system 1 according to a third embodiment will be described below.

Figure 5:
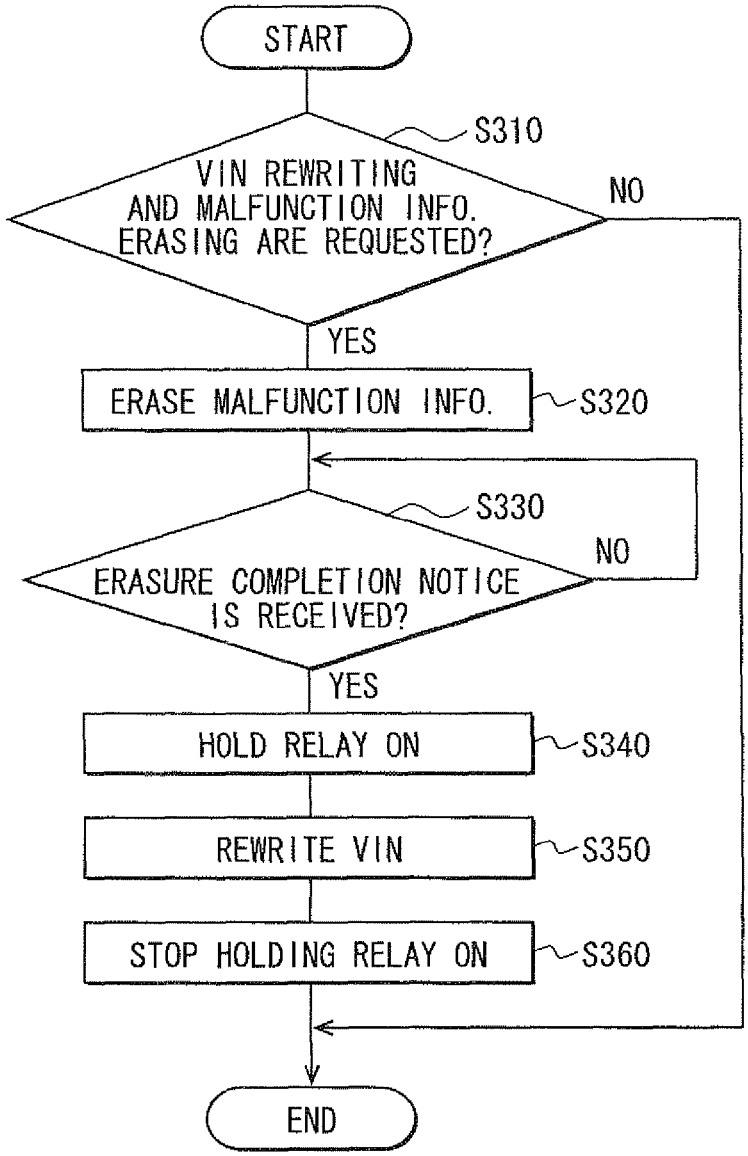
FIG. 5 is a flowchart illustrating a rewriting procedure to be performed by an engine ECU according to a third embodiment.
Figure 6:
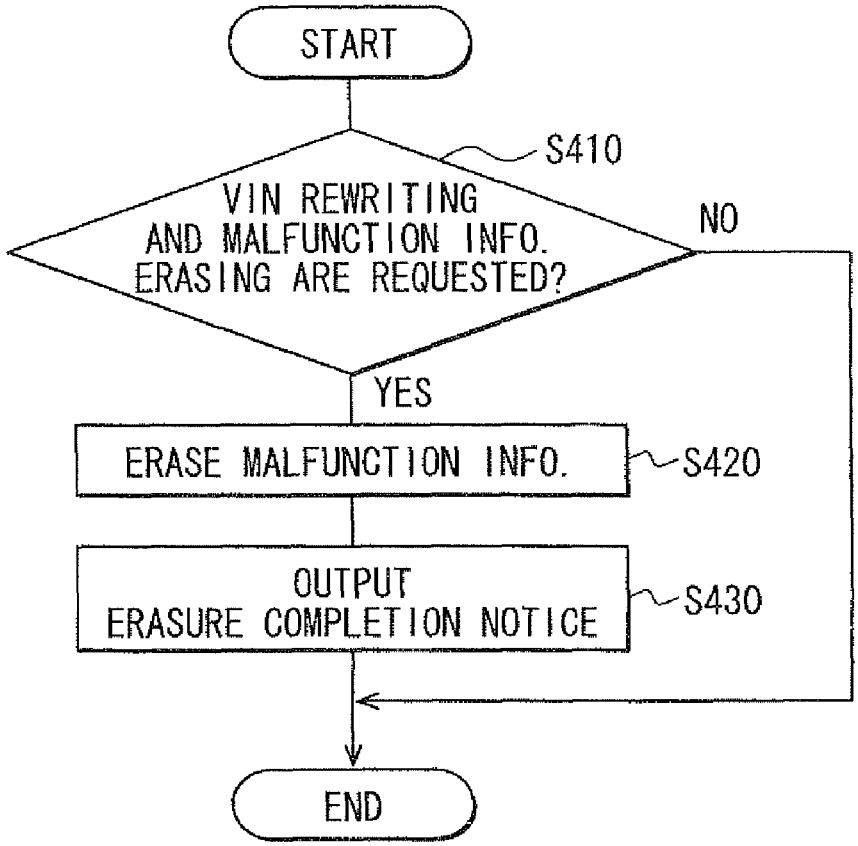
FIG. 6 is a flowchart illustrating an erasure procedure to be performed by an ECU that has malfunction information to be erased, according to the third embodiment.

The vehicle control system 1 of the third embodiment is different from that of the first embodiment in that: the microcomputer 11 of the engine ECU 10 of the third embodiment performs a rewriting procedure illustrated in FIG. 5 in place of that illustrated in FIG. 3; and an ECU (e.g., the HVECU 20 and the ECTECU 30) other than the engine ECU 10 of the third embodiment performs an erasure procedure illustrated in FIG. 6. Explanation is given respectively below on processes illustrated in FIGS. 5 and 6.

As shown in FIG. 5, at S310, the CPU 12 determines whether the instruction information is inputted. The process S310 is the same as the process S110 in FIG. 3, and the detailed explanation on S310 is omitted here.

When the CPU 12 determines that the instruction information is not inputted, corresponding to "NO" at S310, the rewriting procedure is ended. When the CPU 12 determines that the instruction information is inputted, corresponding to "YES" at S310, the process proceeds to S320.

At S320, the CPU 12 erases the malfunction information stored in the subject ECU, which is the engine ECU 10 in this embodiment. At S330, the CPU 12 determines whether the CPU 12 receives erasure completion notices from other different ECUs, which include the HVECU 20 and the ECTECU 30 in this embodiment and can act as an electronic apparatus that is external with respect to the engine ECU 10. The erasure completion notice indicates that the different ECU has completed the erasure of the malfunction information. More specifically, at S330, the CPU 12 determines whether the CPU 12 respectively receives the erasure completion notices from all of the different ECUs that are instructed to perform an operation of erasing the malfunction information. Each of the different ECUs outputs the erasure completion notice when the different ECU performs the below-described process S430.

When the CPU 12 determines that the CPU 12 does not receives the erasure completion notices from all of the different ECUs that should perform the operation of erasing malfunction information, in other words, when the CPU 12 determines that the erasure completion notice from at least one of the different ECUs has not been received yet, the determination "NO" is made at S330. In this case, the CPU performs the process S330 again.

When the CPU 12 determines that the CPU 12 receives the erasure completion notices from all of the different ECUs that are instructed to perform the process of erasing the malfunction information, the determination "YES" is made at S330, and the process proceeds to S340. Because the subsequent processes S340 to S360 can be the substantially same as the processes S140 to S160, the detailed explanation on S340 to S360 is omitted here.

Now, the erasure procedure illustrated in FIG. 6 will be described. The erasure procedure illustrated in FIG. 6 is regularly performed by generally all of the different ECUs, each of which is other than the engine ECU 10 and stores the malfunction information used in malfunction diagnosis. For example, the erasure procedure illustrated in FIG. 6 may be performed by a CPU of a microcomputer of each ECU.

As shown in FIG. 6, at S410, the CPU determines whether the instruction information is inputted. The process S410 is the substantially same as the process S110 illustrated in FIG. 3, the detailed explanation on S410 is omitted here.

When the CPU determines that the instruction information is not inputted, corresponding to "NO" at S410, the erasure procedure illustrated in FIG. 6 is ended. When the CPU determines that the instruction information is inputted, corresponding to "YES" at S410, the process proceeds to S420.

At S420, the CPU erases the malfunction information stored in the ECU performing this erasure procedure. At S430, the CPU outputs an erasure completion notice indicating that the erasure of the malfunction information has been completed. After S430, the erasure procedure illustrated in FIG. 6 is ended.

According to the above vehicle control system 1 of the third embodiment, since a different ECU that has completed the erasure of the malfunction information outputs the erasure completion notice (corresponding to S430), the engine ECU 10 can receive the erasure completion notice and can reliably recognize at S330 that the malfunction information in the different ECU has been erased. After the engine ECU 10 checks at S330 that the malfunction information has been erased in all of ECUs that should erase the malfunction information therein (corresponding to "Yes" at S330), the VIN code rewriting operation is performed at S360. Thus, it is possible to prevent the following situation from realizing. The situation is that the malfunction information has not been erased but remains at a state where the VIN code is rewritten.

For the above reason, the vehicle control system 1 of the third embodiment can prevent the violation of the above-described requirement of OBD-II in a more reliable and certain manner. Furthermore, in the third embodiment, the microcomputer 11 outputs the hold signal (S340) lust before the VIN code rewriting operation at S350. Therefore, when the microcomputer 11 starts performing the VIN code rewriting operation, the VIN code can be reliably rewritten even if the ignition switch is turned off during the VIN code rewriting operation.

In the third embodiment, the process S430, conducted by the use of the CPU, can correspond to erasure completion notice output section or means. The process S330 can correspond to erasure determination section or means. Each of the above-mentioned section or means is merely an illustrated example and not limited to the above-described corresponding item.

Fourth Embodiment

A vehicle control system 1 according to a fourth embodiment will be described below.

Figure 7:
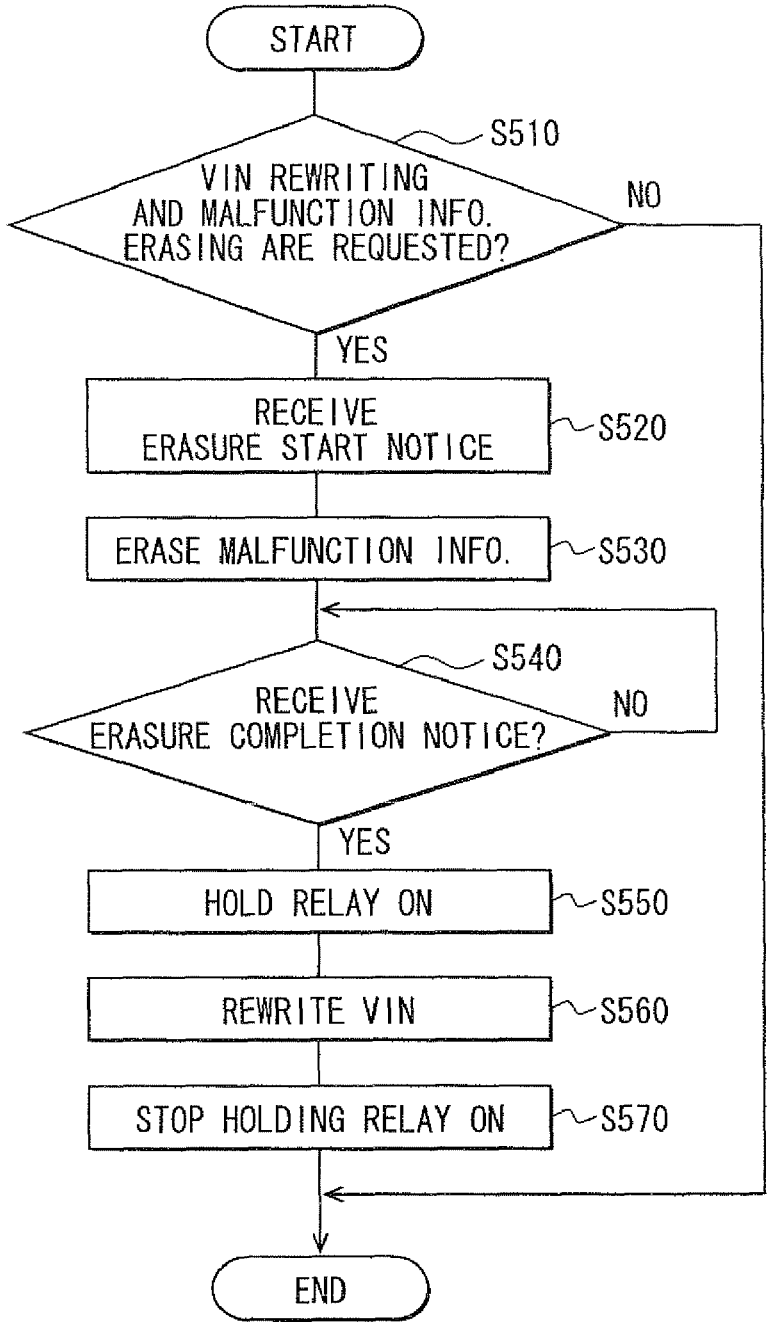
FIG. 7 is a flowchart illustrating a rewriting procedure to be performed by an engine ECU according to a fourth embodiment.
Figure 8:
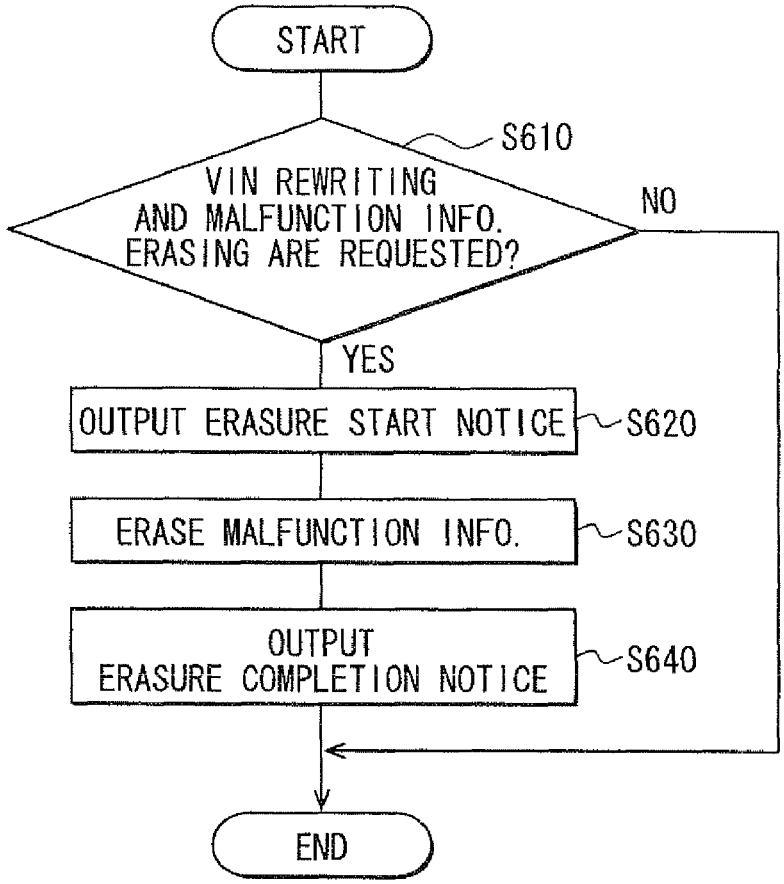
FIG. 8 is a flowchart illustrating an erasure procedure to be performed by an ECU that has malfunction information to be erased, according to the fourth embodiment.

The vehicle control system 1 of the fourth embodiment is different from that of the first embodiment in that the microcomputer 11 of the engine ECU 10 of the fourth embodiment performs a rewriting procedure illustrated in FIG. 7 in place of that illustrated in FIG. 3; the different ECU, which is other than the engine ECU 10 and is HVECU 20 and the ECTECU 30 for example, of the fourth embodiment performs an erasure procedure illustrated in FIG. 8. In the followings, explanation will be given on the processes illustrated in FIGS. 7 and 8.

As shown in FIG. 7, at S510, the CPU 12 determines whether the instruction information is inputted. Because the process S510 is the substantially same as the process S110 illustrated in FIG. 3, the detailed explanation on S510 is omitted here.

When the CPU 12 determines that the instruction information is not inputted, corresponding to "NO" at S510, the rewriting procedure is ended. When the CPU 12 determines that the instruction information is inputted, corresponding to "YES" at S510, the process proceeds to S520.

At S520, the CPU 12 receives an erasure start notice from the different ECU. The erasure start notice is outputted from the different ECU when the different ECU performs the below-described process S620. After S520, the process proceeds to S530. At S530, the CPU 12, which is a component of the engine ECU 10, erases the malfunction information stored in the engine ECU 10.

At S540, the CPU 12 determines whether, from the different ECU, the CPU 12 receives the erasure completion notice indicating that the malfunction information in the different ECU has been erased. Because the process S540 is the substantially same as the above-described S330, the detailed explanation on S540 is omitted here.

When the CPU 12 determines that the erasure completion notice has been received, in other words, when the CPU 12 determines that the CPU 12 has received the erasure completion notices from all of ECUs that should erase the malfunction information therein, the determination "YES" is made at S540, and the process proceeds to S550. Because the subsequent processes S550 to S570 are substantially the same as S140 to S160 illustrated in FIG. 3, the detailed explanation on S550 to S570 is omitted here.

Explanation will be given on the erasure procedure illustrated in FIG. 8. The erasure procedure is regularly performed by generally all of ECUs other than the engine ECU 10, the ECUs each storing therein malfunction information used in malfunction diagnosis. For example, the erasure procedure illustrated in FIG. 8 may be performed by a CPU of a microcomputer of each ECU.

At S610, the CPU determines whether the instruction information is inputted. Because the process S610 is the substantially same as S110 illustrated in FIG. 3, the detailed explanation on S610 is omitted here.

When the CPU determines that the instruction information is not inputted, corresponding to "NO" at S610, the erasure procedure is ended. When the CPU determines that the instruction information is inputted, corresponding to "YES" at S610, the process proceeds to S620.

At S620, the CPU outputs an erasure start notice indicating that erasure of the malfunction information is started. At S630, the CPU erases the malfunction stored in the ECU performing this erasure procedure. At S640, the CPU outputs an erasure completion notice indicating that the erasure of the malfunction information has been completed. After S640, the erasure procedure is ended.

According to the vehicle control system 1 of the fourth embodiment, each ECU having the malfunction information to be erased outputs the erasure start notice at S620 in response to the input of the instruction information at S510 and S610. Thus, at a stage of the input of the instruction information, the engine ECU 10 can recognize in which ECU the malfunction information is to be erased, even if the engine ECU 10 does not have information on such ECU in advance. Therefore, the information on the ECU having the malfunction information to be erased is unnecessary to be pre-registered in the engine ECU 10.

An advantage associated with the above configuration becomes more notable when a certain engine ECU 10 is used in different types of vehicles. More specifically, since the number of ECUs and types of ECUs in the vehicle control system 1 can vary according types of vehicles, the following disadvantage is brought if the information on the ECU having malfunction information to be erased is pre-registered or pre-set in the engine ECU 10. That is, there may arise a necessity that ECU information (i.e., the information on the ECU having malfunction information to be erased) be resisted or set according to vehicle types, or, the ECU information be registered or set so as to cover generally all of different types of vehicles. With this regard, the fourth embodiment does not involve the above-described necessity. The fourth embodiment facilitates the use of the engine ECUs having the substantially same specification in different types of vehicles without involving a specification change.

Moreover, in the fourth embodiment, the microcomputer 11 outputs at S550 the hold signal just before performing the VIN code rewriting operation at S560. Thus, after the microcomputer 11 starts performing the VIN code rewriting operation, the microcomputer 11 can rewrite the VIN code in a reliable manner even if the ignition switch is turned off during the VIN code rewriting operation.

In the fourth embodiment, the process S620, conducted by the use of the CPU, can correspond to an erasure start notice output section or means, for example.

The above embodiments can be modified in various ways, example of which will be described below.

For example, in the first embodiment, the process S140 of outputting the command to hold the relay 55 on may be performed just before S120 (e.g., between S110 and S120). In this configuration, even if the ignition switch 52 is turned off during the erasure of the malfunction information at S120 for instance, since the hold signal from the microcomputer 11 maintains the relay 55 at the ON state and causes the continuous voltage supply to the microcomputer 11, the erasure of the malfunction information can be prevented from being stopped. Therefore, at least in the microcomputer 11, the malfunction information can be erased in a reliable manner.

In the second embodiment, the process S220 may be performed just before S250 (e.g., between S240 and S250).

In the third embodiment, the process S340 may be performed just before S320 (e.g., between S310 and S320).

In the fourth embodiment, the process S550 may be performed lust before S530 (e.g., between S520 and S530) or just before S520 (e.g., between S510 and S520).

According to an aspect of the above embodiments and modifications, an electronic control unit for a vehicle is provided. The electronic control unit includes: a vehicle identification information storage section storing therein vehicle identification information, which is unique on a vehicle-by-vehicle basis; and a rewrite section configured to rewrite the vehicle identification information stored in the vehicle identification information storage section in response to an input of a vehicle identification information rewrite instruction thereto. The electronic control unit is connected with an electronic apparatus via an in-vehicle network of the vehicle. The electronic apparatus includes: a malfunction information storage section storing therein malfunction information of the vehicle; and an erasure section configured to erase the malfunction information stored in the malfunction information storage section in response to an input of a malfunction information erasure instruction thereto. The electronic control unit further includes: an instruction detection section configured to detect an input of instruction information, the input of the instruction information including the input of the vehicle identification information rewrite instruction and the input of the malfunction information erasure instruction; and an erasure determination section configured to determine, in response to detection of the input of the instruction information by the instruction detection section, whether the malfunction information in the electronic apparatus has been erased by the erasure section. The rewrite section rewrites the vehicle identification information when the erasure determination section determines that malfunction information in the electronic apparatus has been erased.

According to the above electronic control unit, when the input of the instruction information is detected, the vehicle identification information is rewritten at a stage where the erasure determination section determines that the malfunction information has been erased by the erasure section. In other words, as long as the malfunction information has not been erased, the vehicle identification information is prohibited from being rewritten.

According to the above configuration, even if there is a possibility in some situations that the malfunction information may fails to be erased and remain unerased due to, for example, the turning off of an ignition switch of the vehicle or the resetting of the electronic apparatus during the erasure of the malfunction information, it is possible to prevent the vehicle identification information from being rewritten while the malfunction information remains unerased. This is because the above electronic control unit can be configured such that the erasure determination section determines that the malfunction information has not been erased, in the case of the turning off of an ignition switch of the vehicle or the reset of the electronic apparatus.

As can be seen from the above, the above electronic control unit rewrites the vehicle identification information at a stage where the malfunction information has been erased. Thus, since no malfunction information remains unerased at a time of rewriting the vehicle identification information, it is possible to prevent violation of a requirement, where the requirement is such that, when vehicle identification information is rewritten, malfunction information be erased at the same time.

The above electronic control unit may also include the malfunction information section and the erasure section like the electronic apparatus has. In this case, the electronic control unit may be configured to store and erase the malfunction information, like the electronic apparatus does.

Alternatively, the above electronic control unit may be configured in the following way. The erasure determination section may be further configured to determine whether a predetermined period has elapsed since the instruction detection section detected the input of the instruction information. The erasure determination section may determine that the malfunction information in the electronic apparatus has been erased, when the erasure determination section determines that the predetermined period has elapsed since the instruction detection section detected the input of the instruction information.

According to the configuration, the vehicle identification information is rewritten in response to the determination that the predetermined period has elapsed since the instruction detection section detected the input of the instruction information.

In the above, the predetermined period may be set sufficiently longer than a period taken for the electronic apparatus to erase the malfunction information. In this setting, the malfunction information has been erased at a stage where the predetermined period has elapsed after the detection of the input of the instruction information. Thus, the above setting enables the vehicle identification information to be rewritten at a stage where the erasure of the malfunction information has been completed. As can be seen from the above, the determination of whether the predetermined has elapsed, which determination is simple, can provide the above-described merit, which is prevention of the violation of the requirement.

Alternatively, the electronic control unit may be configured in the following way. The electronic control unit may be connected, via the in-vehicle network, with a plurality of electronic apparatuses each including (i) the malfunction information above-described storage section, (ii) the above-described erasure section, and (iii) an erasure completion notice section configured to output an erasure completion notice indicating that erasure of the malfunction information has been completed. The erasure determination section may be further configured to determine whether all of the plurality of electronic apparatuses has respectively outputted the erasure completion notices; and the erasure determination section determines that the malfunction information in all of the plurality of electronic apparatuses has been erased, when the erasure determination section determines that all of the plurality of electronic apparatuses has respectively outputted the erasure completion notices.

According to the above configuration, when the electronic apparatus outputs the erasure completion notice in response to the completion of the erasure of the malfunction information, the electronic control unit detects the erasure completion notice. Thus, the electronic control unit can reliably recognize that the malfunction information in the electronic apparatus has been erased. In other words, it is possible to improve reliability of determination result regarding whether the malfunction information in the electronic apparatus has been erased. It is thus possible to rewrite, in a more reliable manner, the vehicle identification information at a stage where the erasure of the malfunction information has been completed. It is therefore possible to enhance the above-described advantage, which is the prevention of the violation of the requirement.

There may be a possibility that when an ignition switch of the vehicle is turned off during the erasure of the malfunction information, the erasure of the malfunction may be stopped and the malfunction information may remain unerased. For addressing this possibility, the above electronic control unit may be configured in the following way.

The erasure determination section may include an off-operation determination portion that is configured to determine whether an ignition switch of the vehicle has been turned off within the predetermined period from the detection of the input of the instruction information. The erasure determination section may determine that the malfunction information in the electronic apparatus has been erased, (i) when the erasure determination section determines that the predetermined period has elapsed since the instruction detection section detected the input of the instruction information and (ii) when the off-operation determination portion determines that the ignition switch of the vehicle has not been switched off within the predetermined period from the detection of the input of the instruction information.

In the above case, the predetermined period may be also set sufficiently longer than a period taken for the electronic apparatus to erase the malfunction information. According to the above electronic control unit, when the predetermined period has elapsed after the detection of the input of the instruction information and when the ignition switch of the vehicle has not been tuned off during the elapse of the predetermined period (which is longer than an actual period of the erasure of the malfunction information), the erasure determination section determines that the malfunction information has been erased, and then the rewrite section rewrites the vehicle identification information. In other words, if the ignition switch of the vehicle has been turned off during the elapse of the predetermined period (e.g., during the erasure of the malfunction information), the erasure determination section determines that the malfunction information has not been erased, and the rewrite section is prohibited from rewriting the vehicle identification information.

As can be seen from the above, it is possible to prohibit the vehicle identification information from being rewritten in a situation where the malfunction information possibly fails to be erased and possibly remains unerased due to the turning off of the ignition switch of the vehicle during the erasure of the malfunction information. In other words, it is possible to rewrite the vehicle identification information at a stage where the erasure of the malfunction information has been completed. It is therefore possible to enhance the above-described advantage, which is the prevention of the violation of the requirement.

The above electronic control may be configured in the following way. The electronic control unit may further include an operating voltage supply switch and an operating voltage supply control section. The operating voltage supply switch is switchable into a supply state and a cut-off state. In the supply state, the operating voltage supply switch allows supply of an operating voltage from a battery of the vehicle to the electronic control unit. In the cut-off state, the operating voltage supply switch cuts off the supply of the operating voltage to the electronic control unit. The operating voltage supply control section is configured to control the operating voltage supply switch. When the erasure section starts the erasure of the malfunction information, the operating voltage supply control section causes the operating voltage supply switch to be held in the supply state. When the off-operation determination portion determines that the ignition switch of the vehicle has been switched off within the predetermined period from the detection of the input of the instruction information, the operating voltage supply control section causes the operating voltage supply switch to be in the cut-off state upon the elapse of the predetermined period.

If the ignition switch is turned off during the predetermined period or during the erasure of the malfunction information, there is a possibility that the erasure of the malfunction may be stopped and the malfunction information remains unerased. According to the above electronic control unit however, since the operating voltage supply control section is switched into the cut-off state when the above-described possibility may be realized, the supply of the operation voltage to the electronic control unit is cut off. In this case, the vehicle identification information is prohibited from being rewritten.

According to the above electronic control unit, the rewriting of vehicle identification information in a case of the malfunction information being unerased can be prevented. It is therefore possible to prevent the violation of the above-described requirement in a more reliable manner.

While the invention has been described above with reference to various embodiments thereof, it is to be understood that the invention is not limited to the above described embodiments and constructions. The invention is intended to cover various modifications and equivalent arrangements. In addition, while the various combinations and configurations described above are contemplated as embodying the invention, other combinations and configurations, including more, less or only a single element, are also contemplated as being within the scope of embodiments.

Further, each or any combination of procedures, processes, steps, or means explained in the above can be achieved as a software section or unit (e.g., subroutine) and/or a hardware section or unit (e.g., circuit or integrated circuit), including or not including a function of a related device; furthermore, the hardware section or unit can be constructed inside of a microcomputer.

Furthermore, the software section or unit or any combinations of multiple software sections or units can be included in a software program, which can be contained in a computer-readable storage media or can be installed in a computer via a communications network.

What is claimed is:

1. An electronic control unit for a vehicle, comprising:

a vehicle identification information storage section that stores vehicle identification information, which is unique on a vehicle-by-vehicle basis; and a rewrite section that rewrites the vehicle identification information stored in the vehicle identification information storage section in response to an input of a vehicle identification information rewrite instruction, wherein the electronic control unit is connected with an electronic apparatus via a network in the vehicle, the electronic apparatus including (i) a malfunction information storage section that stores malfunction information of the vehicle and (ii) an erasure section that erases the malfunction information stored in the malfunction information storage section in response to an input of a malfunction information erasure instruction, the electronic control unit further comprising:

an instruction detection section that detects an input of instruction information, the input of the instruction information including the input of the vehicle identification information rewrite instruction and the input of the malfunction information erasure instruction; and an erasure determination section that determines, in response to detection of the input of the instruction information by the instruction detection section, whether the malfunction information in the electronic apparatus has been erased by the erasure section, wherein the rewrite section rewrites the vehicle identification information when the erasure determination section determines that malfunction information in the electronic apparatus has been erased.

2. The electronic control unit according to claim 1, wherein:

the erasure determination section determines whether a predetermined period has elapsed since the detection of the input of the instruction information by the instruction detection section; and when determining that the predetermined period has elapsed, the erasure determination section determines that the malfunction information in the electronic apparatus has been erased.

3. The electronic control unit according to claim 1, wherein:

the electronic apparatus further includes an erasure completion notification section that outputs an erasure completion notice indicating that erasure of the malfunction information has been completed;

the electronic apparatus is a plurality of electronic apparatuses each including the malfunction information storage section, the erasure section and the erasure completion notification section;

the erasure determination section determines whether the erasure completion notices have been outputted from all of the plurality of electronic apparatuses; and when determining that the erasure completion notices have been outputted from all of the plurality of electronic apparatuses, the erasure determination section determines that the malfunction information in the plurality of electronic apparatuses has been erased.

4. The electronic control unit according to claim 2, wherein:

the erasure determination section includes an off-operation determination portion that determines whether an ignition switch of the vehicle has been turned off within the predetermined period from the detection of the input of the instruction information by the instruction detection section; and the erasure determination section determines that the malfunction information in the electronic apparatus has been erased, when (i) the erasure determination section determines that the predetermined period has elapsed since the detection of the input of the instruction information by the instruction detection section and (ii) the off-operation determination portion determines that the ignition switch of the vehicle has not been switched off within the predetermined period from the detection of the input of the instruction information by the instruction detection section.

5. The electronic control unit according to claim 4, further comprising:

an operating voltage supply switch that is switchable into a supply state where the operating voltage supply switch allows supply of an operating voltage from a battery of the vehicle to the electronic control unit and a cut-off state where the operating voltage supply switch cuts off the supply of the operating voltage; and an operating voltage supply control section that holds the operating voltage supply switch in the supply state when the erasure section starts erasing the malfunction information, wherein, when the off-operation determination portion determines that the ignition switch of the vehicle has been switched off within the predetermined period from the detection of the input of the instruction information by the instruction detection section, the operating voltage supply control section switches the operating voltage supply switch into the cut-off state upon the elapse of the predetermined period.

6. A vehicle control system mounted to a vehicle, comprising:

a vehicle identification information storage section that stores vehicle identification information, which is unique on a vehicle-by-vehicle basis;

a malfunction information storage section that stores malfunction information, which is information on malfunction of the vehicle;

a rewrite section that rewrites the vehicle identification information stored in the vehicle identification information storage section in response to an input of a vehicle identification information rewrite instruction;

an erasure section that erases the malfunction information stored in the malfunction information storage section in response to an input of a malfunction information erasure instruction;

an instruction detection section that detects an input of instruction information, the input of the instruction information including the input of the vehicle identification information rewrite instruction and the input of the malfunction information erasure instruction; and an erasure determination section that determines, in response to detection of the input of the instruction information by the instruction detection section, whether the malfunction information has been erased by the erasure section, wherein:

the erasure section erases the malfunction information stored in the malfunction information storage section when the instruction detection section detects the input of the instruction information; and the rewrite section rewrites the vehicle identification information when the erasure determination section determines that malfunction information has been erased by the erasure section.

7. The vehicle control system according to claim 6, wherein:

the erasure determination section determines whether a predetermined period has elapsed since the detection of the input of the instruction information by the instruction detection section; and when determining that the predetermined period has elapsed, the erasure determination section determines that the malfunction information has been erased.

8. The vehicle control system according to claim 7, wherein:

the erasure determination section includes an off-operation determination portion that determines whether an ignition switch of the vehicle has been turned off within the predetermined period from the detection of the input of the instruction information by the instruction detection section; and the erasure determination section determines that the malfunction information has been erased, when (i) the erasure determination section determines that the predetermined period has elapsed since the detection of the input of the instruction information by the instruction detection section and (ii) the off-operation determination portion determines that the ignition switch of the vehicle has not been switched off within the predetermined period from the detection of the input of the instruction information by the instruction detection section.

9. The vehicle control system according to claim 6, further comprising:

an erasure completion notice output section that outputs, in response to erasure of the malfunction information by the erasure section, an erasure completion notice indicating that the erasure of the malfunction information has been completed; and a plurality of electronic control units each including the malfunction information storage section, the erasure section and the erasure completion notice output section, wherein:

the erasure determination section determines whether the erasure completion notices have been outputted from all of the plurality of electronic control units; and when determining that the erasure completion notices has been outputted from all of the plurality of electronic control units, the erasure determination section determines that malfunction information in the plurality of electronic control units has been erased.

10. The vehicle control system according to claim 9, wherein:

each of the plurality of electronic control units further includes an erasure start notice output section that outputs, when the erasure section starts erasing the malfunction information, an erasure start notice indicating that the erasure of the malfunction information is started.

* * * * *